US010132206B1

(12) United States Patent
Hattiangadi et al.

(10) Patent No.: US 10,132,206 B1
(45) Date of Patent: Nov. 20, 2018

(54) COMMON ROCKER ARM FOR HYDRAULIC LASH ADJUSTER AND NON-HYDRAULIC LASH ADJUSTER

(71) Applicant: Caterpillar Inc., Peoria, IL (US)

(72) Inventors: Ashwin A. Hattiangadi, Edwards, IL (US); Selvakumar Selvaraj, Tamil Nadu (IN)

(73) Assignee: Caterpillar Inc., Deerfield, IL (US)

( * ) Notice: Subject to any disclaimer, the term of this patent is extended or adjusted under 35 U.S.C. 154(b) by 0 days.

(21) Appl. No.: 15/600,253

(22) Filed: May 19, 2017

(51) Int. Cl.

| | |
|---|---|
| ***F01L 1/04*** | (2006.01) |
| ***F01L 1/24*** | (2006.01) |
| ***G05G 1/00*** | (2006.01) |
| ***F01L 1/20*** | (2006.01) |
| ***F01L 1/18*** | (2006.01) |

(52) U.S. Cl.
CPC *F01L 1/24* (2013.01); *F01L 1/18* (2013.01); *F01L 1/20* (2013.01); *G05G 1/00* (2013.01)

(58) Field of Classification Search
CPC ..... F01L 1/18; F01L 1/20; F01L 1/24
USPC ..... 123/90.12, 90.13, 90.39, 90.44
See application file for complete search history.

(56) References Cited

U.S. PATENT DOCUMENTS

| | | | | |
|---|---|---|---|---|
| 4,365,785 | A | 12/1982 | Miller | |
| 5,560,265 | A | 10/1996 | Miller | |
| 8,578,901 | B2 * | 11/2013 | Ruggiero | F01L 1/08 123/90.22 |
| 2016/0146074 | A1 | 5/2016 | Lynch | |
| 2016/0273416 | A1 | 9/2016 | Coffey et al. | |

* cited by examiner

*Primary Examiner* — Ching Chang
(74) *Attorney, Agent, or Firm* — Miller, Matthias & Hull

(57) ABSTRACT

A rocker arm for an engine valve actuator assembly is disclosed. The rocker arm may include a rocker arm body disposed between a first and second arm end. Furthermore, a rocker arm bore and an adjuster compartment may be defined proximal to the second arm end. The rocker arm may further include a roller positioned at the first arm end and operably coupled to a cam, the cam configured to actuate the rocker arm between a first and second position. The rocker arm may further include a shaft inserted through a shaft mounting aperture and the rocker arm is configured to rotate about the shaft between the first and second positions. Furthermore, a fluid passage may be defined within the rocker arm body extending between a first passage opening formed in a bearing surface of the shaft mounting aperture and a second passage opening that opens into the adjuster compartment.

20 Claims, 6 Drawing Sheets

COMMON ROCKER ARM FOR HYDRAULIC LASH ADJUSTER AND NON-HYDRAULIC LASH ADJUSTER

TECHNICAL FIELD

The present disclosure generally relates to actuator assemblies for engines and, more particularly, relates to actuator assemblies that incorporate hydraulic lash adjusters and non-hydraulic lash adjusters used to adjust engine valve assemblies.

BACKGROUND

Each cylinder of an engine, for example a diesel engine, is equipped with one or more valves (e.g., intake and exhaust valves) that are cyclically opened during normal operation. The valves may be opened by way of an actuator assembly that includes a driving member, such as a camshaft, and a rocker arm. The camshaft includes one or more lobes arranged at particular angles corresponding to desired lift timings and number of the associated valves. The lobes are connected to stem ends of the associated valves by way of the rocker arm and linkage components. Furthermore, the rocker arm may be coupled with a valve adjuster that further interacts with the valves. As the camshaft rotates, the rocker arm pivots according to the one or more lobes of the camshaft, thereby causing a second end of the rocker arm to actuate the valve adjuster.

When an engine is equipped with different types of valves (e.g., intake valves and/or exhaust valves), different types of valve adjusters (e.g., non-hydraulic lash adjusters and/or hydraulic lash adjusters) may be coupled with the rocker arms to actuate the valves. To reduce the different number of camshafts, lobes, and/or rocker arms required to pair with the different types of valve adjusters, a common rocker arm, or the like, may be used to interconnect different types of valve adjusters with the corresponding valves.

For example, an exemplary rocker arm may be configured to interconnect with non-hydraulic lash adjusters. As such, an alternative rocker arm is needed to interconnect with hydraulic lash adjusters. The rocker arm can be configured such that both non-hydraulic lash adjusters and hydraulic lash adjusters can be interchangeably coupled to and decoupled from the rocker arm. A common rocker arm design capable of being used with either non-hydraulic lash adjusters or hydraulic lash adjusters may help simplify maintenance procedures on engines that incorporate both type of valve adjuster.

U.S. Pat. No. 8,161,936 ("Kraft et al.") describes an internal combustion engine that has an engine braking device. A hydraulic lash adjuster is disclosed in Kraft et al. to be arranged between a rocker arm and a valve bridge and provide automatic compensation to the valve lash for the engine exhaust valves. Furthermore, the engine braking device comprises a hydraulic valve control unit hydraulically connected to the hydraulic valve lash adjuster.

While arguably effective for its intended purpose, improvements beyond Kraft continue to be sought in the engine industry. It is with respect to these considerations and others made by the disclosure that is herein presented.

SUMMARY OF THE DISCLOSURE

In accordance with one aspect of the disclosure, a rocker arm for an engine valve actuator assembly is disclosed. The rocker arm may be interchangeably configured to pair with both a hydraulic lash adjuster and a non-hydraulic lash adjuster. The rocker arm may include a rocker arm body having a first arm end and a second arm end, the rocker arm body defining a rocker arm bore and an adjuster compartment proximal to the second arm end, the rocker arm bore extending from a top surface into the adjuster compartment and the adjuster compartment configured to be compatible with each of the hydraulic lash adjuster and the non-hydraulic lash adjuster. Moreover, a roller may be positioned at the first arm end and operably coupled to cam, and the cam may be configured to actuate the rocker arm between a first position and a second position, and the rocker arm body may further define a shaft mounting aperture extending through a rocker arm first lateral surface to a second lateral surface. Furthermore, a shaft may be inserted through the shaft mounting aperture such that the rocker arm is configured to rotate about the shaft between the first position and the second position. Additionally, the rocker arm may include a fluid passage defined within the rocker arm body and extending from a first passage opening to a second passage opening, wherein the first passage opening is formed through a bearing surface of the shaft mounting aperture and the second passage opening opens into and delivers a fluid supply to the adjuster compartment.

In accordance with another aspect of the disclosure, a rocker arm for an engine valve actuator assembly is disclosed. The rocker arm may be interchangeably configured to pair with both a hydraulic lash adjuster and a non-hydraulic lash adjuster. The rocker arm may further include, a rocker arm body including a first arm end and a second arm end, the rocker arm body defining a rocker arm bore and an adjuster compartment proximal to the rocker arm second end, the rocker arm bore extending from a top surface into the adjuster compartment and the adjuster compartment configured to be compatible with each of the hydraulic lash adjuster and the non-hydraulic lash adjuster. Moreover, a roller may be positioned at the first arm end and operably coupled to the cam, and the cam may be configured to actuate the rocker arm between a first position and a second position, and the rocker arm body further defining a shaft mounting aperture extending through a rocker arm first lateral surface to a rocker arm second lateral surface and positioned between the first arm end and the second arm end. Additionally, a shaft may be inserted through the shaft mounting aperture, and the shaft mounting aperture may be positioned in the rocker arm body to define a specific distance between a roller center point and a shaft center point such that when the rocker arm rotates about the shaft a side load placed on the engine valve is optimized. The rocker arm may further include a fluid passage defined within the rocker arm body and extending from a first passage opening to a second passage opening, wherein the first passage opening is formed through a bearing surface and the second passage opening opens into and delivers a fluid supply to the adjuster compartment.

In accordance with a further aspect of the disclosure, an actuator assembly for an engine including at least one engine valve is disclosed. The actuator assembly may include a cam shaft configured with a cam profile and a rocker arm interchangeably configured to pair with a non-hydraulic lash adjuster and a hydraulic lash adjuster. The rocker arm may include a rocker arm body including a first arm end and a second arm end, the rocker arm body defining a rocker arm bore and an adjuster compartment proximal to the second arm end, the rocker am bore extending from a top surface into the adjuster compartment and the adjuster compartment includes an interior surface having a surface roughness of less than or equal to 0.4 microns such that each of the non-hydraulic lash adjuster and the hydraulic lash adjuster is slidably inserted and slidably removed from the adjuster compartment. Moreover, a roller may be positioned at the first arm end and operably coupled to the cam shaft, and the cam shaft profile may be configured to actuate the rocker arm between a first position and a second position, and the rocker arm body further defining a shaft mounting aperture extending through a rocker arm first lateral surface and a rocker arm second lateral surface and positioned between the first arm end and the second arm end. Furthermore, a shaft inserted through the shaft mounting aperture, and the shaft mounting aperture positioned in the rocker arm body to define a specific distance between a roller center point and a shaft center point such that when the rocker arm rotates about the shaft between the first position and the second position a side load exerted on the engine valve is optimized. Additionally, a fluid passage may be defined within the rocker arm body and extending from a first passage opening to a second passage opening, wherein the first passage opening is formed through a bearing surface and the second passage opening opens into and delivers a fluid supply to the adjuster compartment.

DETAILED DESCRIPTION

Figure 1:
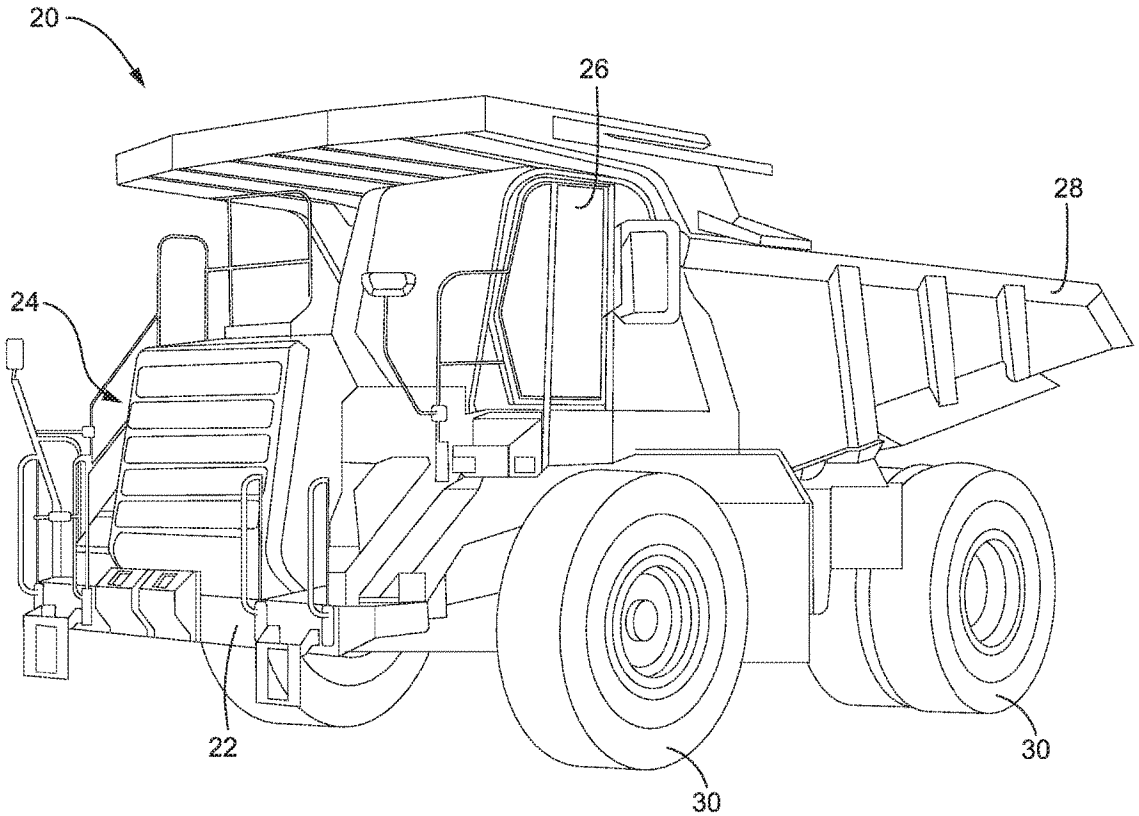
FIG. 1 is a perspective view of a machine, in accordance with an embodiment of the present disclosure.

Referring now to the drawings and with specific reference to FIG. 1, a machine 20 is shown, in accordance with certain embodiments of the present disclosure. While one non-limiting example of the machine 20 is illustrated as an off-road truck, it will be understood the machine 20 may include other types of machines such as but not limited to, an on-road truck, a track-type machine, a motor grader, industrial mining equipment, a locomotive, an automobile, a marine vessel, electricity generating equipment, and any other such machine or piece of equipment. The machine 20 may include a frame 22 configured to support an engine 24, an operator compartment 26, and a dump bed 28. Moreover, the engine 24 may be configured as an internal combustion engine, a diesel engine, a natural gas engine, a hybrid engine or any combination thereof, and the engine 24 may be configured as a power generating source that produces the operational power used to operate the machine 20. The machine 20 may further include a set of ground engaging members 30 rotatably coupled to the frame 22 and driven by the engine 24 in order to propel the machine 20 in a direction of travel. Although the set of ground engaging members 30 is shown as a set of wheels, other types of engagement devices, such as continuous tracks and the like, may be used. It is to be understood that the machine 20 is shown primarily for illustrative purposes to assist in disclosing features of various embodiments of the present disclosure, and that FIG. 1 may not depict all of the components of the machine 20.

Figure 2:
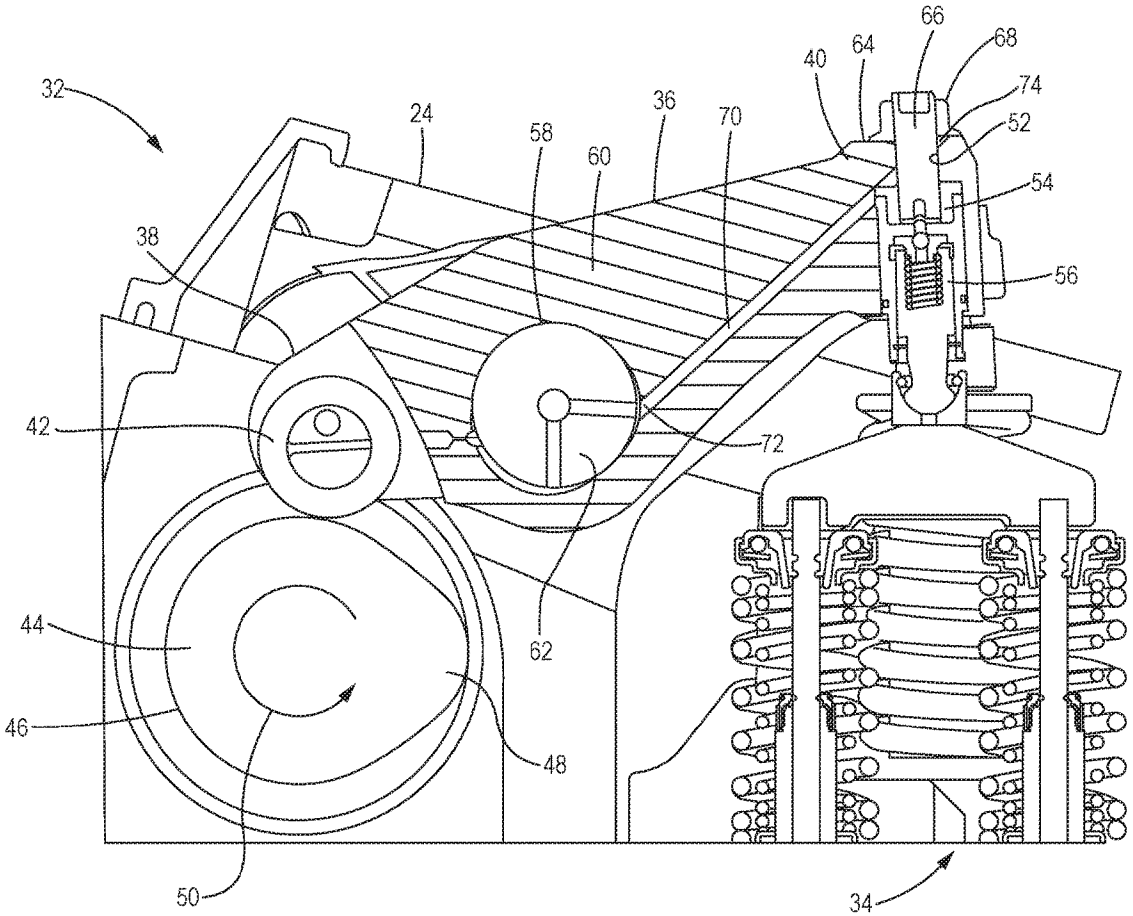
FIG. 2 is a schematic, cross-section of a portion of the exemplary actuator assembly for the engine of the machine in FIG. 1, in accordance with an embodiment of the present disclosure.

FIG. 2 illustrates one non-limiting example of an actuator assembly 32 incorporated with the engine 24 of the machine 20 (FIG. 1). In some embodiments, the actuator assembly 32 is configured to actuate (i.e., open and close) an engine valve 34 of the engine 24, such as but not limited to, an engine intake valve, an engine exhaust valve or other such valve. The actuator assembly 32 comprises a rocker arm 36 that incorporates features of the present disclosure. The rocker arm 36 includes a first arm end 38 and a second arm end 40. The first arm end 38 includes a roller 42 that may be operatively connected to a cam shaft 44, or other such driving member. Furthermore, the cam shaft 44 may be configured with a cam profile 46 that includes one or more lobes 48. The cam shaft 44 may rotate, illustrated by the arrow 50, and the cam shaft 44 rotation may cause an actuation of the rocker arm 36 (a rocker arm 36 actuated by the lobe 48 of a cam shaft 44 may be referred to as a cam-actuated rocker arm). More specifically, the roller 42 of the first arm end 38 may be operatively connected to the cam profile 46 and the lobe 48 of a cam shaft 44 such that as the cam shaft 44 rotates the rocker arm 36 may be actuated between a first position and a second position; however, the actuator assembly 32 may be configured to actuate the rocker arm 36 between more than just two positions.

Additionally, the rocker arm 36 defines a bore 52 and an adjuster compartment 54, both disposed proximal to the second arm end 40. The adjuster compartment 54 is configured to slidably receive a valve adjuster 56. Moreover, the adjuster compartment 54 may be configured such that the rocker arm 36 is compatible with more than one type of valve adjuster 56, such as but not limited to, a hydraulic lash adjuster, a non-hydraulic lash adjuster, or other such adjuster. In one non-limiting example, the adjuster compartment 54 may be cylindrical in shape. However, the adjuster compartment 54 may be alternatively configured based on the shape, size, or other such characteristic of the valve adjuster 56 that is inserted into the adjuster compartment 54. In some embodiments, the rocker arm 36 is configured with a shaft mounting aperture 58 extending through a portion of a rocker arm body 60. Furthermore, a shaft 62 may be inserted through the shaft mounting aperture 58 such that the rocker arm 36 is rotatably mounted onto the shaft 62. As a result, rotation or other such actuation of the cam shaft 44 may cause the rocker arm 36 to rotate about the shaft 62.

The bore 52 may extend from an outer surface 64 of the rocker arm 36 to the adjuster compartment 54. Furthermore, the valve adjuster 56 that is inserted into the adjuster compartment 54 may include a boss 66 that is inserted through the bore 52. In one non-limiting example, the boss 66 extends from above the outer surface 64 of the rocker arm 36 into a portion of the adjuster compartment 54. Moreover, the boss 66 may be operatively coupled to the valve adjuster 56 in the adjuster compartment 54. The boss 66 may be secured to the rocker arm 36 by a nut 68, or other such securing mechanism. Additionally, the rocker arm 36 may include a fluid passage 70 that is formed within the rocker arm body 60 of the rocker arm 36. The fluid passage 70 may extend from a first end 72 that is proximal to the shaft mounting aperture 58 to a second end 74 that is proximal to the adjuster compartment 54. In one non-limiting example, the first end 72 of the fluid passage 70 opens into the shaft mounting aperture 58 and the second end 74 of the fluid passage 70 open into the adjuster compartment 54. As a result, the shaft mounting aperture 58 and the adjuster compartment 54 may be in fluid communication with one another through the fluid passage 70. The fluid passage 70 may transport oil, hydraulic fluid, or other such fluid from the shaft mounting aperture 58 to the adjuster compartment 54. Moreover, the actuator assembly 32 may use the fluid contained in adjuster compartment 54 to activate the valve adjuster 56 and adjust (i.e., open and close) the engine valve 34.

Figure 3:
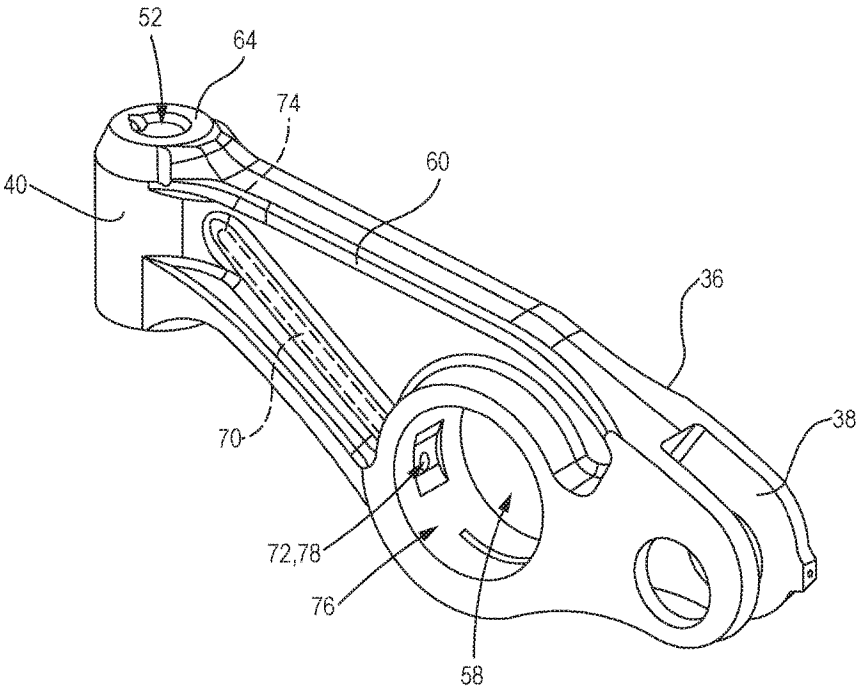
FIG. 3 is a perspective view of a rocker arm incorporated into the actuator assembly of FIG. 2, in accordance with an embodiment of the present disclosure.

Referring to FIG. 3, an exemplary rocker arm 36 is illustrated. As discussed above, the rocker arm 36 may have a rocker arm body 60 that is disposed between the first arm end 38 and the second arm end 40. Furthermore, the bore 52 may be proximally located to the second arm end 40 and the bore 52 extends from the outer surface 64 of the rocker arm 36 into the adjuster compartment 54 (FIG. 2). Additionally, shaft mounting aperture 58 is formed in a portion of the rocker arm body 60 and the shaft mounting aperture 58 is configured to extend through the rocker arm 36. In some embodiments, the shaft mounting aperture 58 includes a shaft interface surface 76. The shaft interface surface 76 may be in contact with the shaft 62 (FIG. 2) and the shaft interface surface 76 may be configured to facilitate the rotation of the shaft 62 (FIG. 2) within the shaft mounting aperture 58. Moreover, the shaft interface surface 76 may be configured as a bearing surface or other such surface that facilitates the rotation of the shaft 62 (FIG. 2) within the shaft mounting aperture 58.

In one non-limiting example, the rocker arm 36 and the shaft 62 (FIG. 2) may be rotatably coupled without the use of a bushing, bearing, or other such lining of the shaft mounting aperture 58. As a result, the shaft interface surface 76 may be configured to have a low surface roughness in order to facilitate smooth rotation of the shaft 62 (FIG. 2). For example, the shaft interface surface 76 may be finished or otherwise machined with a surface roughness having an arithmetic average (Ra) of less than 0.8 microns; however, the shaft interface surface 76 may be configured with other surface roughness values. Alternatively, the rocker arm 36 and the shaft 62 (FIG. 2) may be rotatably coupled with the incorporation of a bushing, such as but not limited to, a steel back nickel bronze bushing. Furthermore, the rocker arm 36, and more specifically the shaft interface surface 76, may undergo a heat treating process, such as but not limited to, nitriding, carbonizing, diffusion hardening, or other such treatment. In some embodiments, the heat treating process may harden the shaft interface surface 76 such that the shaft 62 (FIG. 2) and the rocker arm 36 may be rotatably coupled without the use of the bushing.

The rocker arm 36 further includes the fluid passage 70 that extends from the shaft mounting aperture 58 to the second arm end 40 and the adjuster compartment 54. Furthermore, a fluid passage opening 78 may be formed in the shaft interface surface 76 and the fluid passage opening 78 is aligned with the first end 72 of the fluid passage 70. As a result, fluid may enter the fluid passage opening 78 from shaft interface surface 76 of the shaft mounting aperture 58. In some embodiments, the fluid may perform several functions such as provide lubrication on the shaft interface surface 76, provide pressurized fluid to the adjuster compartment 54, and other such functions.

Figure 4:
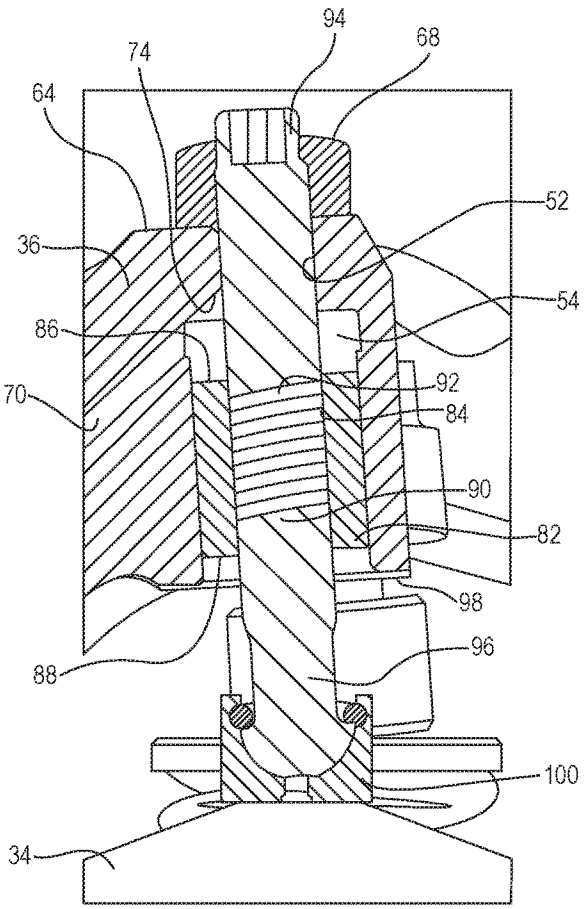
FIG. 4 is an enlarged cross-section of an exemplary non-hydraulic lash adjuster and the rocker arm of FIG. 3, in accordance with an embodiment of the present disclosure.

Referring to FIG. 4, with continued reference to FIG. 2, one exemplary valve adjuster 56 is shown as a non-hydraulic lash adjuster 80. The non-hydraulic lash adjuster 80 may include an insert 82 that may be removably positioned within a portion of the adjuster compartment 54. In some embodiments, the insert 82 may be formed from hardened steel, or other such metal, and the insert 82 can be slidably inserted into the adjuster compartment 54. Moreover, the insert 82 may be configured to plug, or otherwise block the second end 74 of the fluid passage 70 that opens up into the adjuster compartment 54. Generally, the insert 82 is used with the first non-hydraulic lash adjuster 80 because the fluid (i.e., hydraulic fluid) transported through the fluid passage 70 is not used by the non-hydraulic lash adjuster 80.

The insert 82 may further include an insert bore 84 that extends from a top surface 86 of the insert 82 to a bottom surface 88 of the insert 82. Moreover a valve adjuster piston 90 may be inserted through the insert bore 84. The valve adjuster piston 90 may include a set of piston threads 92 on at least a portion of the valve adjuster piston 90 and the piston threads 92 may mate with a corresponding set of insert threads (not shown) that are formed on an interior surface of the insert bore 84. As a result, the piston threads 92 may mesh with the insert threads (not shown) to position, secure, and otherwise adjust the valve adjuster piston 90 within the insert 82. In one non-limiting example, the valve adjuster piston 90 is configured as a unitary structure that includes a boss portion 94 and a plunger portion 96. The boss portion 94 may extend upwards through the adjuster compartment 54 and through the bore 52 formed in the outer surface 64 of the rocker arm 36. Furthermore, the boss portion 94 may mate with the nut 68, and the nut 68 may be configured to secure the boss portion 94 of the valve adjuster piston 90 to the outer surface 64 of the rocker arm 36. Additionally, the plunger portion 96 may extend downwards through the adjuster compartment 54 such that the plunger portion 96 protrudes from a lower surface 98 of the rocker arm 36. In some embodiments, the plunger portion 96 may mate with a retention member 100 that is disposed between the rocker arm 36 and the engine valve 34.

Figure 5:
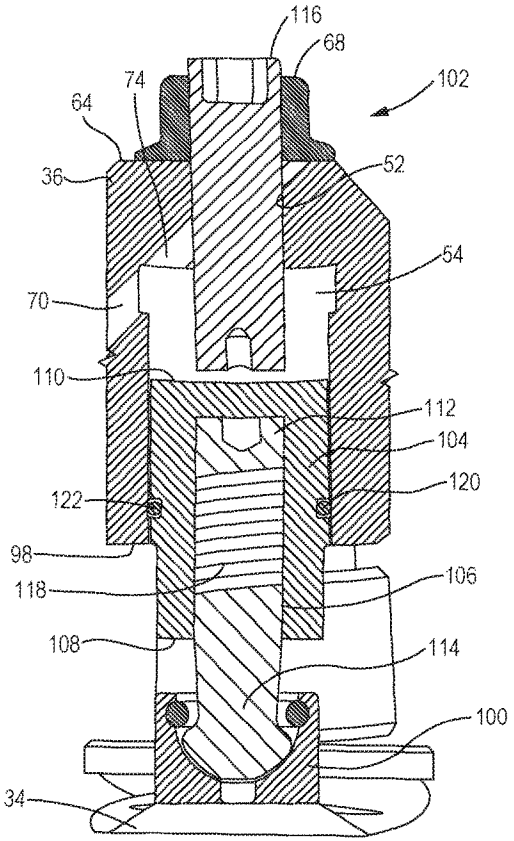
FIG. 5 is an enlarged cross-section of an alternative non-hydraulic lash adjuster and the rocker arm of FIG. 3, in accordance with an embodiment of the present disclosure.

Referring to FIG. 5, with continued reference to FIG. 2, an alternative non-hydraulic lash adjuster 102 is illustrated. The alternative non-hydraulic lash adjuster 102 may include an alternative insert 104 that may be removably positioned within a portion of the adjuster compartment 54. In some embodiments, the alternative insert 104 may be formed from hardened steel, or other such metal, and the alternative insert 104 can be slidably inserted into the adjuster compartment 54. Moreover, the alternative insert 104 may be configured to plug, or otherwise block the second end 74 of the fluid passage 70 that opens up into the adjuster compartment 54. Generally, the alternative insert 104 is used with the alternative non-hydraulic lash adjuster 102 because the fluid (i.e., hydraulic fluid) transported through the fluid passage 70 is not used by the alternative non-hydraulic lash adjuster 102.

The alternative insert 104 may further include an insert compartment 106 that extends from a bottom surface 108 towards a top surface 110 of the alternative insert 104. However, as opposed to the insert bore 84 of the insert 82 shown in FIG. 4, the insert compartment 106 does not extend all the way through the alternative insert 104. Moreover, an alternative adjuster piston 112 may be inserted into the insert compartment 106 and the alternative adjuster piston 112 includes a plunger portion 114 and a boss portion 116; the plunger portion 114 and the boss portion 116 are formed as separate structures. The plunger portion 114 may include a set of plunger threads 118 on at least a portion of the plunger portion 114 and the plunger threads 118 may mate with a corresponding set of insert threads (not shown) that are formed on an interior surface of the insert compartment 106. As a result, the plunger threads 118 may mesh with the insert threads (not shown) to position, secure, and otherwise adjust the plunger portion 114 within the alternative insert 104.

Additionally, the alternative adjuster piston 112 includes the boss portion 116 that is formed separately from the plunger portion 114. The boss portion 116 may extend through the bore 52 formed in the outer surface 64 of the rocker arm 36 and the boss portion 116 may be configured to directly contact the top surface 110 of the alternative insert 104. Furthermore, the boss portion 116 may mate with the nut 68, and the nut 68 may be configured to secure the boss portion 116 to the outer surface 64 of the rocker arm 36. The plunger portion 114 may extend exteriorly from the insert compartment 106 such that the plunger portion 114 protrudes from the lower surface 98 of the rocker arm 36. In some embodiments, the plunger portion 114 may mate with the retention member 100 that is disposed between the rocker arm 36 and the engine valve 34. Additionally, the alternative insert 104 may have a groove 120 defined in the outer surface of the alternative insert 104. In some embodiments, the groove 120 may be positioned adjacent to the lower surface 98 of the rocker arm 36; however other positions of the groove 120 are possible. The groove 120 may be configured to receive a sealing element 122 such as but not limited to, an O-ring. The sealing element 122 may compress against the interior wall of the adjuster compartment 54 and form a fluid tight seal between the alternative insert 104 and the rocker arm 36. Similarly, the groove 120 and the sealing element 122 may be incorporated with the insert 82 shown in FIG. 4 to form a fluid tight seal between the insert 82 and the rocker arm 36.

Figure 6:
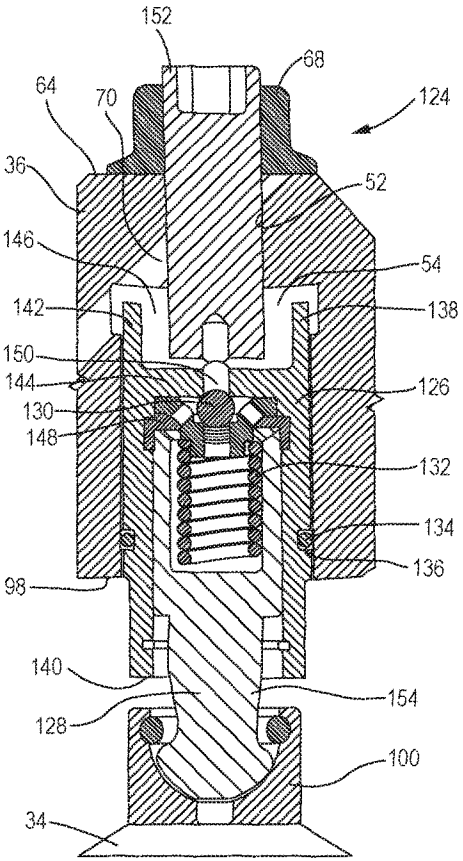
FIG. 6 is a an enlarged cross-section of an exemplary hydraulic lash adjuster and the rocker arm of FIG. 3, in accordance with an embodiment of the present disclosure.

Referring now to FIG. 6, a hydraulic lash adjuster (HLA) 124 incorporated with the rocker arm 36 is shown. The hydraulic lash adjuster 124 includes a HLA body 126, a HLA piston 128, a check valve 130 and a spring 132. The hydraulic lash adjuster 124 may further include a sealing element 134, such as an O-ring, contained within a groove 136 such that the sealing element 134 is disposed around the HLA body 126. Similar, to the non-hydraulic lash adjusters 80, 102 (FIGS. 4 and 5), the hydraulic lash adjuster 124 is configured to be slidingly removable from (configured to be slid out of) and slidingly insertable into (configured to be slid into) the adjuster compartment 54 of the rocker arm 36. As discussed above, in an embodiment, the adjuster compartment 54 is configured such that the interior surface of the adjuster compartment 54 has a smooth surface finish to allow the hydraulic lash adjuster 124 to be slidingly insertable. For example, the interior surface of the adjuster compartment 54 has a surface finish with an arithmetic average (Ra) of less than or equal to 0.4 microns.

In one embodiment, such as the one shown in FIG. 6, the HLA body 126 may be cylindrical in shape. The HLA body 126 has a top end 138 and a bottom end 140. The top end 138 of the HLA body 126 is configured to be disposed inside the adjuster compartment 54 and the bottom end 140 may extend beyond the lower surface 98 of the rocker arm 36. The HLA body 126 further includes a sidewall 142 that surrounds a floor 144. The floor 144 may be disposed below the top end 138 of the HLA body 126. The floor 144 may be disposed generally perpendicular to the sidewall 142. Herein, with respect to the orientation of the floor 144 in relation to the sidewall 142, generally perpendicular means plus or minus fifteen (15) degrees. The inventors have found that the positioning of the floor 144 between the top end 138 and the bottom end 140 of the HLA body 126 inhibits or eliminates bulging of the sidewall 142 that might occur in some situations due to stress on the sidewall 142.

The sidewall 142 and the floor 144 define an upper cavity 146 and a lower cavity 148. Furthermore, the floor 144 may include a passage 150 that extends between the upper cavity 146 and the lower cavity 148. The passage 150 defines a fluid pathway to the check valve 130. As a result, the fluid transported to the upper cavity 146 through the fluid passage 70 formed in the rocker arm 36. Moreover, depending on the position of the check valve 130, the fluid may then flow through the passage 150 and into the lower cavity 148. The lower cavity 148 is configured to receive the HLA piston 128 and when the fluid enters the lower cavity 148 the fluid may act upon the HLA piston 128 and cause an actuation of the HLA piston 128.

The hydraulic lash adjuster 124 further includes a boss portion 152 that is formed as a separate component from the HLA piston 128. The boss portion 152 extends through the bore 52 formed in the outer surface 64 of the rocker arm 36 and the boss portion 152 may engage the floor 144 of the HLA body 126. Furthermore, the boss portion 152 may mate with the nut 68, and the nut 68 may be configured to secure the boss portion 152 to the outer surface 64 of the rocker arm 36. Additionally, the HLA piston 128 includes a plunger portion 154 that may extend from the lower cavity 148 such that the plunger portion 154 protrudes from the lower surface 98 of the rocker arm 36. Similar to the non-hydraulic lash adjusters 80, 102 (FIGS. 4 and 5), the plunger portion 154 may mate with the retention member 100 that is disposed between the rocker arm 36 and the engine valve 34.

Figure 8:
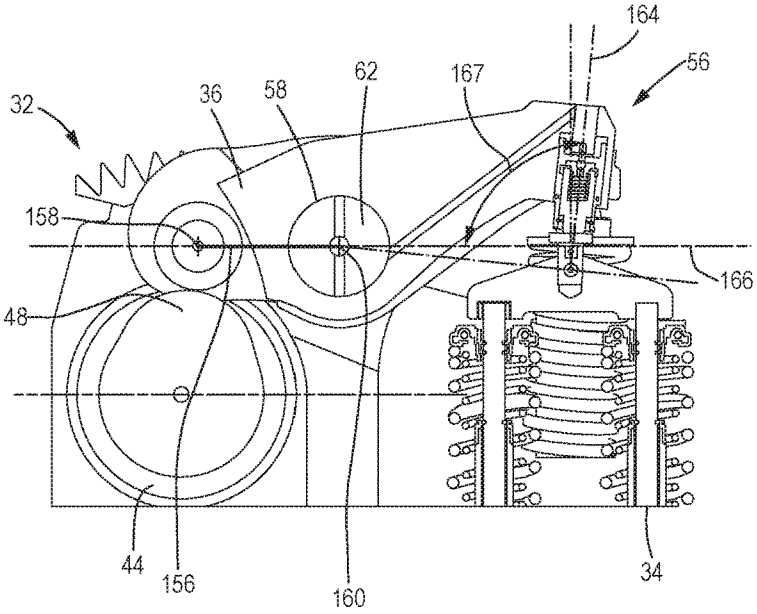
FIG. 8, is a schematic, cross section of a portion of the actuator assembly of FIG. 7 rotated in a second position, in accordance with an embodiment of the present disclosure.
Figure 7:
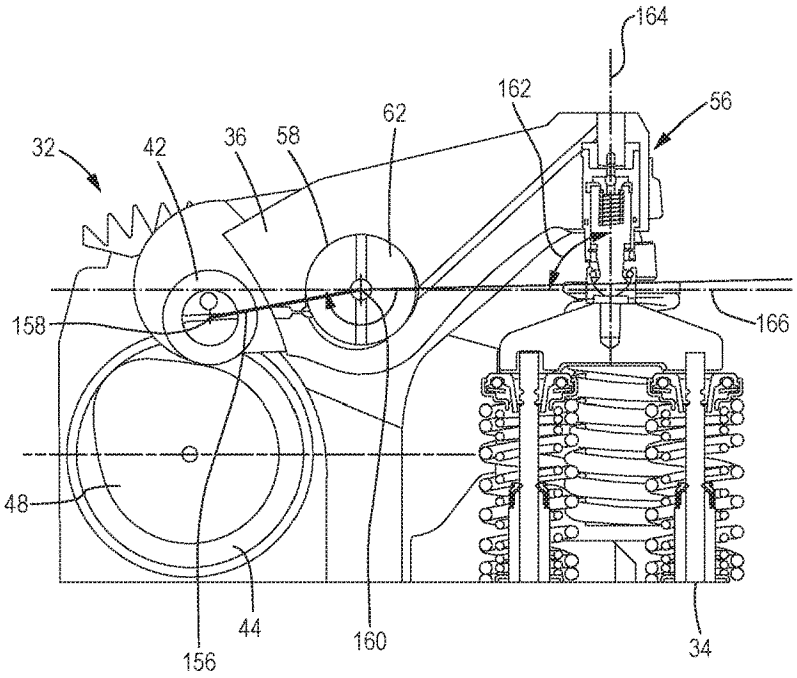
FIG. 7 is a schematic, cross-section of the a portion of the actuator assembly including an exemplary embodiment of the rocker arm of FIG. 3, in accordance with an embodiment of the present disclosure.

Referring now to FIGS. 7 and 8, an embodiment of the rocker arm 36 that is configured to optimize the side load placed on the engine valve 34 is shown. As discussed above, the rocker arm 36 may be incorporated with the actuator assembly 32 used to actuate one or more engine valves 34. The rocker arm 36 includes the shaft mounting aperture 58 for rotatably mounting the rocker arm 36 onto the shaft 62 such that the rocker arm 36 may be able to pivot or rotate between a plurality of positions. Moreover, the rocker arm 36 may be optimized to pivot such that the rocker arm 36 may be used for different types of engine valves 34 such as intake valves, exhaust valves, and other such valves.

Furthermore, the rocker arm 36 may include the roller 42 which is operably coupled to the cam shaft 44. The interaction between the roller 42 and the cam shaft 44 causes the rocker arm 36 to pivot, thereby causing the valve adjuster 56 to actuate the engine valve 34. In one non-limiting example illustrated in FIG. 7, the rocker arm 36 may be adjusted to have a perfect 0 degree horizontal loading at a specific rotation of the cam shaft 44 (e.g., −77 degrees); however other rotations are possible. Adjusting the rocker arm to have 0 degrees of horizontal loading may help to reduce the side load of the rocker arm 36 over the entire actuation cycle (i.e., from no lift to maximum lift). Furthermore, a distance 156 that is measured between a roller center point 158 and a shaft center point 160 may also be optimized such that a side load exerted by the rocker arm 36 on the engine valve 34 is reduced during pivoting of the rocker arm 36.

In one non-limiting example, the 0 degrees of horizontal loading on the rocker arm 36 and engine valve 34 may be measured by an angle 162 that is formed between a vertical axis 164 extending through the valve adjuster 56 and a horizontal axis 166 of the rocker arm 36 that runs through the shaft center point 160. For example, the angle 162 between the vertical axis 164 and the horizontal axis 166 may measure 90 degrees when the rocker arm 36 is adjusted to produce 0 degrees of horizontal loading on the engine valve 34. Furthermore, the cam shaft 44 may be rotated into a position to produce a minimum amount, or even zero amount, of lift on the rocker arm 36. As a result, the rocker arm 36 rotates about the shaft 62 such that the angle 162 between the vertical axis 164 and the horizontal axis 166 may measure approximately 87 degrees; however other angles may be formed depending on the desired side load optimization. Alternatively, in an embodiment as illustrated in FIG. 8, the cam shaft 44 may be rotated into a position to produce the maximum amount of lift on the rocker arm 36. As such, the rocker arm 36 rotates about the shaft and forms an angle 167 between the vertical axis 164 and the horizontal axis 166 that measured approximately 96.5 degrees; however other angles may be formed depending on the desired side load optimization.

INDUSTRIAL APPLICABILITY

The present disclosure generally relates to actuator assemblies for a machine, and more particularly, relates to a common rocker arm for use with different types of actuator assemblies configured to actuate one or more engine valves of an engine. By providing a common rocker arm that can be interchangeably used with actuator assemblies that include non-hydraulic lash adjusters, hydraulic lash adjusters, and other such adjusters, the common rocker arm may be used to retrofit or repair engines that use a non-hydraulic lash adjuster or a hydraulic lash adjuster. Furthermore, the common rocker arm design may reduce replacement part costs by eliminating the use of different rocker arms for non-hydraulic lash adjusters and hydraulic lash adjusters. Additionally, maintenance and repair time may be reduced because the same procedures may be followed to repair and/or replace the rocker arm for both non-hydraulic lash adjusters and hydraulic lash adjusters.

The actuator assembly 32 disclosed herein may incorporate the rocker arm 36 configured to be used with both non-hydraulic lash adjusters 80, 102 and hydraulic lash adjusters 124. The rocker arm 36 may be incorporated with a variety of machines and equipment that use an internal combustion engine (e.g., diesel engine, gasoline engine, and the like) to generate power. Moreover, the machine 20 which may incorporate the rocker arm 36 may include, but are not limited to, off-road trucks, on-road trucks, excavators, loaders, earth movers, bulldozers, motor graders, automobiles, locomotives and the like.

Figure 9:
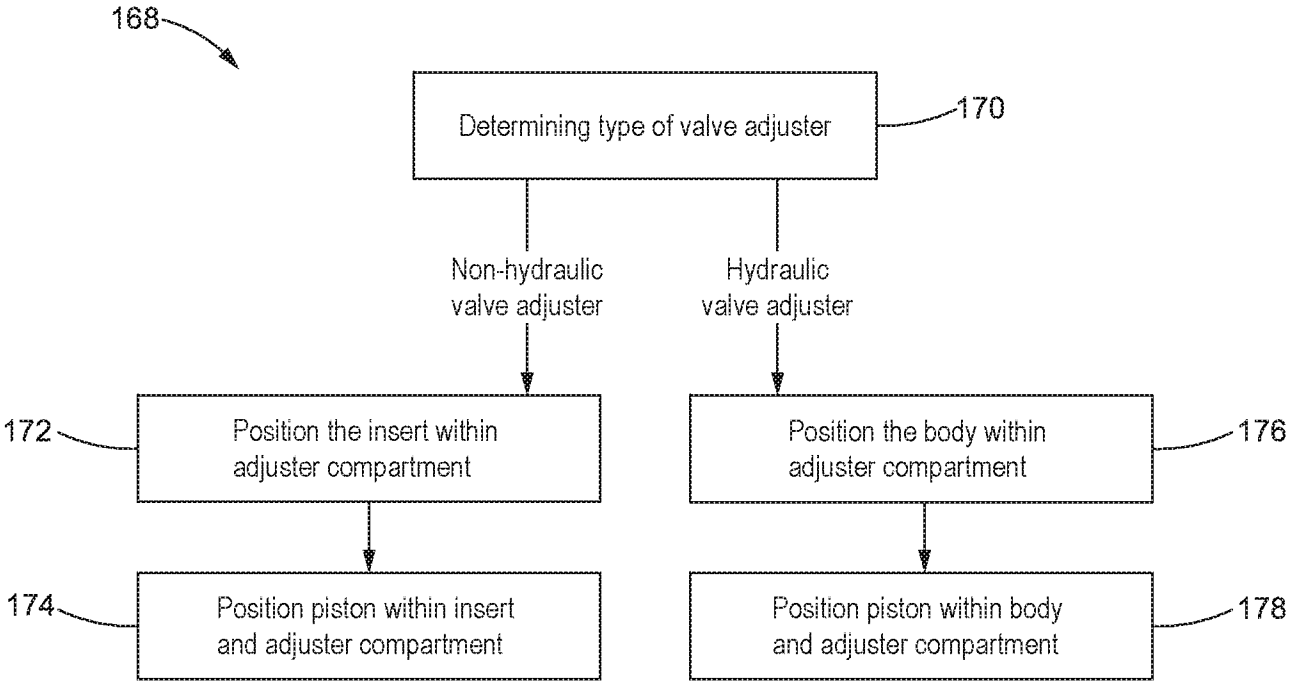
FIG. 9 is an exemplary method of incorporating the rocker arm into the actuator assembly.

FIG. 9 illustrates an exemplary method 164 for incorporating the rocker arm 36 into an actuator assembly 32 that uses either the non-hydraulic lash adjuster 80, 102 or the hydraulic lash adjuster 124. The method 168 may include, in a first block 170, determining the type of valve adjuster 56 the rocker arm 36 will be coupled to. As discussed above, the rocker arm 36 may have an adjuster compartment 54 that is compatible with the non-hydraulic lash adjusters 80, 102 and the hydraulic lash adjuster 124. In some embodiments, the adjuster compartment 54 is configured with a surface roughness having an arithmetic average (Ra) that is equal to or less than 0.4 microns. Such a surface roughness may allow the rocker arm 36 to be interchangeably paired with the different valve adjusters 56 (e.g., non-hydraulic lash adjuster 80, 102 and hydraulic lash adjuster 124).

If the rocker arm 36 will be used with the non-hydraulic lash adjuster 80, 102, then in a block 172, the insert 82, 104 may be slidably inserted into the adjuster compartment 54 of the rocker arm 36. In some embodiments, the insert 82, 104 may be configured to block or contain the fluid supply that may be transported to the adjuster compartment 54 through the fluid passage 70 formed within the rocker arm 36. In one non-limiting example, the insert 82 is configured with the insert bore 84 that extends from the top surface 86 to the bottom surface 88 of the insert 82. In a next block 174, the valve adjuster piston 90 may be inserted through the insert bore 84. The valve adjuster piston 90 may include a set of piston threads 92 on at least a portion of the valve adjuster piston 90. The piston threads 92 may mate with a corresponding set of insert threads (not shown) that are formed on an interior surface of the insert bore 84. As a result, the piston threads 92 may mesh with the insert threads (not shown) to position, secure, and otherwise adjust the valve adjuster piston 90 within the insert 82. Furthermore, the valve adjuster piston 90 may include the boss portion 94 and a plunger portion 96. The boss portion 94 extends upwards through the adjuster compartment 54 and through the bore 52 formed in the outer surface 64 of the rocker arm 36. Furthermore, the boss portion 94 may mate with the nut to secure the boss portion 94 to the outer surface 64 of the rocker arm 36. As such, the valve adjuster piston 90 may further secure the insert 82 within the adjuster compartment 54. Additionally, the plunger portion 96 may extend downwards and protrudes from a lower surface 98 of the rocker arm 36. In some embodiments, the plunger portion 96 may mate with a retention member 100 that is disposed between the rocker arm 36 and the engine valve 34.

Alternatively, in block 172, the alternative insert 104 may be slidably inserted into the adjuster compartment 54 of the rocker arm 36. The alternative insert 104 may include an insert compartment 106 that extends from a bottom surface 108 towards a top surface 110 of the alternative insert 104. However, as opposed to the insert bore 84 of the insert 82, the insert compartment 106 does not extend all the way through the alternative insert 104. Moreover, an alternative adjuster piston 112 may be inserted into the insert compartment 106 and the alternative adjuster piston 112 includes a plunger portion 114 that includes a set of plunger threads 118 on at least a portion of the plunger portion 114. The plunger threads 118 may mate with a corresponding set of insert threads (not shown) on interior surface of the insert compartment 106 to position, secure, and otherwise adjust the plunger portion 114 within the alternative insert 104. In some embodiments, the alternative adjuster piston 112 includes the boss portion 116 formed separately from the plunger portion 114. The boss portion 116 extends through the bore 52 formed in the outer surface 64 of the rocker arm 36 and the boss portion 116 may be configured to directly contact the top surface 110 of the alternative insert 104. Furthermore, the boss portion 116 may mate with the nut 68, and the nut 68 may be configured to secure the boss portion 116 to the outer surface 64 of the rocker arm 36. As a result, the boss portion 116 and the nut may help to position and secure the alternative insert 104 within the adjuster compartment 54.

If the rocker arm 36 will be used with the hydraulic lash adjuster 124, then in block 176, the HLA body 126 is slidably inserted into the adjuster compartment 54 of the rocker arm 36. The HLA body 126 has a top end 138 and a bottom end 140. The top end 138 of the HLA body 126 is configured to be disposed inside the adjuster compartment 54 and the bottom end 140 may extend beyond the lower surface 98 of the rocker arm 36. The HLA body 126 further includes a sidewall 142 that surrounds a floor 144. The floor 144 may be disposed below the top end 138 of the HLA body 126. The sidewall 142 and the floor 144 define an upper cavity 146 and a lower cavity 148. Furthermore, the floor 144 may include a passage 150 that defines the fluid pathway between the upper cavity 146 and the lower cavity 148. The hydraulic lash adjuster 124 further includes the HLA piston 128 that may include the boss portion 152 and the plunger portion 154, and in a next block 178, the HLA piston is coupled with the rocker arm 36. In one non-limiting example, the boss portion 152 may directly contact or otherwise engage the floor 144 of the HLA body 126. Furthermore, the boss portion 152 may extend through the bore 52 formed in the outer surface 64 of the rocker arm 36 mate with the nut 68. The nut 68 may be configured to secure the boss portion 152 to the outer surface 64 of the rocker arm 36. Additionally, the HLA piston 128 includes a plunger portion 154 that may extend from the lower cavity 148 such that the plunger portion 154 protrudes from the lower surface 98 of the rocker arm 36. Similar to the non-hydraulic lash adjusters 80, 102 (FIGS. 4 and 5), the plunger portion 154 may mate with the retention member 100 that is disposed between the rocker arm 36 and the engine valve 34.

While the foregoing detailed description has been given and provided with respect to certain specific embodiments, it is to be understood that the scope of the disclosure should not be limited to such embodiments, but that the same are provided simply for enablement and best mode purposes. The breadth and spirit of the present disclosure is broader than the embodiments specifically disclosed and encompassed within the claims appended hereto. Moreover, while some features are described in conjunction with certain specific embodiments, these features are not limited to use with only the embodiment with which they are described, but instead may be used together with or separate from, other features disclosed in conjunction with alternate embodiments.

What is claimed is:

1. A rocker arm for an engine valve actuator assembly, the rocker arm interchangeably configured to pair with both a hydraulic lash adjuster and a non-hydraulic lash adjuster, the rocker arm comprising:

a rocker arm body including a first arm end and a second arm end, the rocker arm body defining a rocker arm bore and an adjuster compartment proximal to the second arm end, the rocker arm bore extending from a top surface into the adjuster compartment and the adjuster compartment is configured to be compatible with each of the hydraulic lash adjuster and the non-hydraulic lash adjuster;

a roller positioned at the first arm end and operably coupled to a cam, the cam configured to actuate the rocker arm between a first position and a second position, and the rocker arm body further defining a shaft mounting aperture extending through a rocker arm first lateral surface to a rocker arm second lateral surface;

a shaft inserted through the shaft mounting aperture such that the rocker arm is configured to rotate about the shaft between the first position and the second position; and a fluid passage defined within the rocker arm body and extending from a first passage opening to a second passage opening, wherein the first passage opening is formed through a bearing surface of the shaft mounting aperture and the second passage opening opens into and delivers a fluid supply to the adjuster compartment.

2. The rocker arm of claim 1, further comprising an insert configured to be slidably inserted and slidably removed from the adjuster compartment, wherein the insert is positioned within the adjuster compartment to contain the fluid supply within a portion of the adjuster compartment when the rocker arm is used with the non-hydraulic lash adjuster.

3. The rocker arm of claim 2, wherein the insert includes an insert bore extending from a top surface to a bottom surface of the insert, and a non-hydraulic adjuster piston is inserted into the insert bore.

4. The rocker arm of claim 3, wherein the non-hydraulic adjuster piston is configured as a unitary structure, wherein a boss portion of the non-hydraulic adjuster piston extends from the top surface of the insert through the rocker arm bore of the rocker arm, and wherein a plunger portion of the non-hydraulic adjuster piston extends from the bottom surface of the insert and the plunger portion makes contact with an engine valve.

5. The rocker arm of claim 3, wherein the insert bore includes a set of threads configured to mate with a corresponding set of threads on a non-hydraulic adjuster piston such that the non-hydraulic adjuster piston is secured and positioned within the insert.

6. The rocker arm of claim 1, further comprising an adjuster body configured to be slidably inserted and slidably removed from the adjuster compartment when the rocker arm is used with the hydraulic lash adjuster, wherein the adjuster body includes a floor of the adjuster body that separates the adjuster compartment into an upper cavity and a lower cavity.

7. The rocker arm of claim 6, wherein a boss portion is inserted through the rocker arm bore of the rocker arm and a lower surface of the boss portion is operatively engaged with the floor of the adjuster body, and wherein a plunger portion is inserted into the lower cavity of the adjuster body.

8. The rocker arm of claim 7, further comprising a passage formed in the floor to fluidly couple the upper cavity with the lower cavity, wherein the fluid supply delivered into the adjuster compartment is transported through the passage and interacts with the plunger portion in the lower cavity.

9. The rocker arm of claim 1, wherein an interior surface of the adjuster compartment is configured with a surface roughness less than or equal to 0.8 microns.

10. A rocker arm for an engine valve actuator assembly, the rocker arm interchangeably configured to pair with both a hydraulic lash adjuster and a non-hydraulic lash adjuster, the rocker arm comprising:

a rocker arm body including a first arm end and a second arm end, the rocker arm body defining a rocker arm bore and an adjuster compartment proximal to the second arm end, the rocker arm bore extending from a top surface into the adjuster compartment and the adjuster compartment is configured to be compatible with each of the hydraulic lash adjuster and the non-hydraulic lash adjuster;

a roller positioned at the first arm end and operably coupled to a cam, the cam configured to actuate the rocker arm between a first position and a second position, and the rocker arm body further defining a shaft mounting aperture extending through a rocker arm first lateral surface to a rocker arm second lateral surface and positioned between the first arm end and the second arm end;

a shaft inserted through the shaft mounting aperture, and the shaft mounting aperture positioned in the rocker arm body to define a specific distance between a roller center point and a shaft center point such that when the rocker arm rotates about the shaft a side load placed on the engine valve is optimized; and a fluid passage defined within the rocker arm body and extending from a first passage opening to a second passage opening, wherein the first passage opening is formed through a bearing surface and the second passage opening opens into and delivers a fluid supply to the adjuster compartment.

11. The rocker arm of claim 10, wherein the first position of the rocker arm defines a no lift position of the rocker arm, and the specific distance between the roller center point and the shaft center point defines an angle of 87 degrees formed between a vertical axis of a valve adjuster and a horizontal axis of the shaft center point.

12. The rocker arm of claim 11, wherein the second position of the rocker arm defines a maximum lift position of the rocker arm, and the specific distance between the roller center point and the shaft center point defines an angle of 96 degrees formed between the vertical axis of the valve adjuster and the horizontal axis of the shaft center point.

13. The rocker arm of claim 10, further comprising an insert configured to be slidably inserted and slidably removed from the adjuster compartment, wherein the insert is positioned within the adjuster compartment to contain the fluid supply within a portion of the adjuster compartment when the rocker arm is used with the non-hydraulic lash adjuster.

14. The rocker arm of claim 10, further comprising an adjuster body configured to be slidably inserted and slidably removed from the adjuster compartment when the rocker arm is used with the hydraulic lash adjuster, wherein the adjuster body includes a floor of the adjuster body that separates the adjuster compartment into an upper cavity and a lower cavity.

15. The rocker arm of claim 14, wherein a boss portion is inserted through the rocker arm bore of the rocker arm and a lower surface of the boss portion is operatively engaged with the floor of the adjuster body, and wherein a plunger portion is inserted into the lower cavity of the adjuster body and the plunger portion extends exteriorly to a lower surface of the rocker arm.

16. The rocker arm of claim 15, further comprising a passage formed in the floor to fluidly couple the upper cavity with the lower cavity, wherein the fluid supply delivered into the adjuster compartment is transported through the passage and interacts with the plunger portion in the lower cavity.

17. The rocker arm of claim 10, wherein an interior surface of the adjuster compartment is configured with a surface roughness less than or equal to 0.8 microns.

18. An actuator assembly for an engine including at least one engine valve, the actuator assembly comprising:

a cam shaft configured with a cam shaft profile; and a rocker arm interchangeably configured to pair with a non-hydraulic lash adjuster and a hydraulic lash adjuster, the rocker arm including:

a rocker arm body including a first arm end and a second arm end, the rocker arm body defining a rocker arm bore and an adjuster compartment proximal to the second arm end, the rocker arm bore extending from a top surface into the adjuster compartment and the adjuster compartment includes an interior surface having a surface roughness of less than or equal to 0.8 microns such that each of the non-hydraulic lash adjuster and the hydraulic lash adjuster is slidably inserted and slidably removed from the adjuster compartment;

a roller positioned at the first arm end and operably coupled to the cam shaft, and the cam shaft profile configured to actuate the rocker arm between a first position and a second position, and the rocker arm body further defining a shaft mounting aperture extending through a rocker arm first lateral surface to a rocker arm second lateral surface and positioned between the first arm end and the second arm end;

a shaft inserted through the shaft mounting aperture, and the shaft mounting aperture positioned in the rocker arm body to define a specific distance between a roller center point and a shaft center point such that when the rocker arm rotates about the shaft between the first position and the second position a side load exerted on the engine valve is optimized; and a fluid passage defined within the rocker arm body and extending from a first passage opening to a second passage opening, wherein the first passage opening is formed through a bearing surface and the second passage opening opens into and delivers a fluid supply to the adjuster compartment.

19. The actuator assembly of claim 18, wherein an insert is slidably inserted and positioned within the adjuster compartment to contain the fluid supply within a portion of the adjuster compartment when the rocker arm is used with the non-hydraulic lash adjuster.

20. The actuator assembly of claim 18, wherein an adjuster body is slidably inserted within the adjuster compartment when the rocker arm is used with the hydraulic lash adjuster, wherein the adjuster body includes a floor that separates the adjuster compartment into an upper cavity and a lower cavity, and wherein a passage is formed in the floor to fluidly couple the upper cavity with the lower cavity such that the fluid supply delivered into the adjuster compartment is further transported through the passage from the upper cavity to the lower cavity.

* * * * *